US010531735B1

(12) United States Patent
Lucio

(10) Patent No.: US 10,531,735 B1
(45) Date of Patent: Jan. 14, 2020

(54) DOUBLE STORAGE SHOE RACK

(71) Applicant: Liberty Procurement Co. Inc., Union, NJ (US)

(72) Inventor: Thomas A. Lucio, Bronx, NY (US)

(73) Assignee: Liberty Procurement Co. Inc., Union, NJ (US)

( * ) Notice: Subject to any disclaimer, the term of this patent is extended or adjusted under 35 U.S.C. 154(b) by 0 days.

(21) Appl. No.: 16/142,567

(22) Filed: Sep. 26, 2018

(51) Int. Cl.
*A47B 57/04* (2006.01)
*A47B 61/04* (2006.01)

(52) U.S. Cl.
CPC ..... *A47B 57/04* (2013.01); *A47B 61/04* (2013.01)

(58) Field of Classification Search
CPC ..... A47B 57/04; A47B 61/04
USPC ..... 211/34, 36, 38, 150
See application file for complete search history.

(56) References Cited

U.S. PATENT DOCUMENTS 1,401,356 A * 12/1921 Parchert ..... A43D 117/00 211/36
1,944,649 A * 1/1934 Smith, Sr. ..... A47F 7/08 211/150
2,104,828 A 1/1938 Brinnon
2,466,882 A * 4/1949 Echlin ..... A47B 57/04 108/61
2,884,297 A * 4/1959 Hanson ..... A47F 7/06 211/150
3,044,631 A * 7/1962 Greenman ..... A47B 57/04 108/1
3,115,254 A * 12/1963 Dowdall ..... A47B 57/04 108/108
3,199,473 A * 8/1965 Smith ..... A47B 61/04 108/108
3,570,679 A * 3/1971 Edson ..... A47F 7/163 108/1
4,383,722 A * 5/1983 Weber ..... A47B 57/04 211/37
4,456,316 A * 6/1984 Lundgren ..... A47B 61/04 312/229
5,622,272 A * 4/1997 Orlando, Jr. ..... A47B 57/04 211/150
6,679,189 B1 * 1/2004 Henningfeld ..... A47B 47/05 108/106
7,350,649 B1 * 4/2008 Martens ..... A47B 57/06 211/150
7,963,404 B2 6/2011 Shang
(Continued)

FOREIGN PATENT DOCUMENTS

CH 230243 A * 12/1943 ..... A47B 61/04
CH 404117 A * 12/1965 ..... A47B 57/04
(Continued)

*Primary Examiner* — Stanton L Krycinski
(74) *Attorney, Agent, or Firm* — Lerner, David, Littenberg, Krumholz & Mentlik, LLP

(57) ABSTRACT

A rack for storing items that typically come in pairs. The rack includes a frame, a first shelf pivotally connect to the frame, and a second shelf connected to the frame beneath the first shelf such that the second shelf is declined toward the base from a side of the second shelf nearest a front of the frame to a side of the second shelf nearest a back of the frame. The first shelf being moveable from a first position in which a portion of the first shelf is spaced a distance from the second shelf and a second position in which the portion of the first shelf is moved away from the second shelf.

19 Claims, 5 Drawing Sheets

(56) References Cited

U.S. PATENT DOCUMENTS

| | | | | |
|---|---|---|---|---|
| 8,813,980 | B1 * | 8/2014 | Billman | A47B 47/042<br>144/347 |
| 9,445,666 | B2 | 9/2016 | Chang | |
| 2005/0252869 | A1 * | 11/2005 | Graham | A47B 61/04<br>211/36 |
| 2011/0174749 | A1 | 7/2011 | Chen | |
| 2012/0000872 | A1 * | 1/2012 | Troyner | A47B 47/021<br>211/150 |
| 2012/0223041 | A1 * | 9/2012 | Lee | A47B 57/04<br>211/150 |

FOREIGN PATENT DOCUMENTS

| | | | | |
|---|---|---|---|---|
| CH | 610505 | A5 * | 4/1979 | A47B 57/04 |
| DE | 2739385 | A1 * | 3/1979 | A47B 57/04 |
| DE | 3932115 | A1 * | 4/1991 | A47B 61/04 |
| EP | 0029819 | A1 | 6/1981 | |
| FR | 1103089 | A * | 10/1955 | A47B 55/02 |
| FR | 1175540 | A * | 3/1959 | A47B 61/04 |
| FR | 2345107 | A1 * | 10/1977 | A47B 57/04 |
| FR | 2797162 | A1 * | 2/2001 | A47B 61/04 |
| FR | 2797162 | B1 * | 9/2001 | A47B 61/04 |
| GB | 196573 | A * | 5/1923 | A47B 57/04 |
| GB | 766411 | A * | 1/1957 | A47B 57/04 |
| WO | WO-2014035083 | A1 * | 3/2014 | A47B 57/04 |
| WO | WO-2017195932 | A1 * | 11/2017 | A47B 61/04 |

* cited by examiner

DOUBLE STORAGE SHOE RACK

BACKGROUND OF THE INVENTION

The present invention generally relates to storage and, more particularly, to an apparatus for storing items that come in pairs.

When a household item is not in use, it is often stored, for example, in a closet. While this makes for a more organized home, it leads to closets being one the most cluttered spaces of the home, complicating the process of retrieving items from the closet.

One item frequently stored in closets is shoes. A single person typically has a shoe collection consisting of several pairs of shoes to wear during different occasions and to match various outfits. Shoes are traditionally stored at the bottom a closet, thereby monopolizing a majority of the floor space. As the closet becomes cluttered, retrieving a desired pair of shoes become an increasingly difficult task. All too often a person locates a first shoe and frustratingly searches for its matching shoe. For this reason, various shoe racks have been developed in order to free up floor space and bring order to the closet.

Traditional floor racks are rested upon the ground and include shelves that allow a user to stack shoes while they are not being worn. Suspension racks on the other hand, are suspended from a wall, a door, or from a closet rod, and store shoes within cloth pouches.

Although traditional floor racks and suspension racks are more space efficient than storing shoes on a closet floor, both racks have drawbacks. Traditional floor racks, for example, are often either not large enough to store an entire shoe collection or so large that the shoe rack requires a generously sized walk-in-closet. While suspension racks are more space efficient than traditional floor racks, shoes stored within the cloth pouches may not be visible, rendering the task of selecting a pair of shoes to wear more difficult. Furthermore, larger boots and high heeled shoes may not fit within the pouches.

There therefore is a need for a more efficient shoe rack that both stores and displays shoes when they are not being worn.

BRIEF SUMMARY OF THE INVENTION

In accordance with a first aspect of the present invention, an apparatus for efficiently storing shoes is provided. Among other advantages, the apparatus optimizes the amount of shoes that the shoe rack can store without hindering visibility of the stored shoes.

In one embodiment, a storage rack includes a frame having a base, a first shelf pivotally connected to the frame, and a second shelf connected to the frame beneath the first shelf. The second shelf may be declined toward the base from a side of the second shelf nearest a front of the frame to a side of the second shelf nearest a back of the frame. The first shelf may be moveable from a first position in which a portion of the first shelf is positioned a predetermined distance from the second shelf to a second position in which the portion of the first shelf is moved away from the second shelf.

The first shelf may pivot about an axis extending along the back of the frame. The first shelf may include a handle in order to assist a user in pivoting the first shelf. The first shelf may further include a stopping member adjacent or otherwise near a backend of the first shelf to prevent shoes from sliding off of the shelf when it is pivoted.

When the first shelf is in the first position, the first shelf and the second shelf may be angled relative to one another such that the second shelf is configured to receive a shoe with minimal clearance between the shoe and the first shelf. For example, when the first shelf is in the first position, the first shelf and the second shelf may form an angle relative to one another between 10 degrees and 45 degrees.

The second shelf may be static or fixed stationary relative to the frame. The second shelf may also include a stopping member adjacent a side of the second shelf nearest the back of the frame or include a gripping surface.

In a preferred embodiment, the storage rack also includes a third shelf pivotally connected to the frame, and a fourth shelf connected to the frame above the first shelf and beneath the third shelf. The fourth shelf may be declined toward the base from a side of the fourth shelf nearest the front of the frame to a side of the fourth shelf nearest the back of the frame. The third shelf may be moveable from a first position in which the third shelf is substantially parallel to the base to a second position in which at least a portion of the third shelf is moved away from the fourth shelf.

When the third shelf is in its first position, the fourth shelf may be configured to receive a shoe with minimal clearance between the shoe and the third shelf. When the first shelf is in its first position and the third shelf is in its first position, the first shelf and the third shelf may be spaced a distance apart of 12 inches or less.

In another embodiment, a storage rack includes a frame having a base and a top, a plurality of dynamic shelves pivotally connected to the frame and spaced apart from one another, and a plurality of declined shelves connected to the frame. Each one of the plurality of declined shelves may be angled toward the base of the frame from a front side of the declined shelf to a back side of the declined shelf. The plurality of dynamic shelves and the plurality of the declined shelves may be alternatively connected to the frame from the top end of the frame to the base of the frame. Each one of the plurality of dynamic shelves may be moveable relative to the frame from a first position in which the dynamic shelf is substantially parallel with a ground surface to a second position in which at least a portion the dynamic shelf is moved further away from the ground surface.

The plurality of dynamic shelves may be configured to pivot about an axis extending along a back of the frame. Each one of the plurality of dynamic shelves may include a handle to assist a user in pivoting the shelf from the first position to the second position and a stopping member to prevent a shoe from sliding off of the shelf when the shelf is pivoted to its second position.

The plurality of declined shelves may be fixed stationary relative to the frame and include a gripping surface and/or a stopping member to prevent a shoe from sliding off of the angled shelf.

When one of the plurality of dynamic shelves is the first position, its respective declined shelf may be configured to receive a shoe with minimal clearance between the shoe and the one of the plurality of dynamic shelves. For example, the one of the plurality of dynamic shelves and its respective declined shelf may form an angle relative to one another between 10 degrees and 45 degrees.

In an exemplary embodiment, the storage rack may include three dynamic shelves and three declined shelves.

BRIEF DESCRIPTION OF THE DRAWINGS

Various embodiments of the present disclosure are described herein with reference to the following drawings in which.

DETAILED DESCRIPTION

As used herein, the term "front," when used in connection with a shoe rack, refers to a side of the shoe rack closest to a user, whereas the term "back" when used in connection with the shoe rack, refers to a side of the shoe rack farthest from the user. When terms of orientation, for example, "vertical" and "horizontal" or relative terms, for example, "above," "higher," "beneath," "below," and alike, are used to describe the relative position of features, the terms are in reference to a ground surface upon which the shoe rack rests or hangs above.

Figure 1:
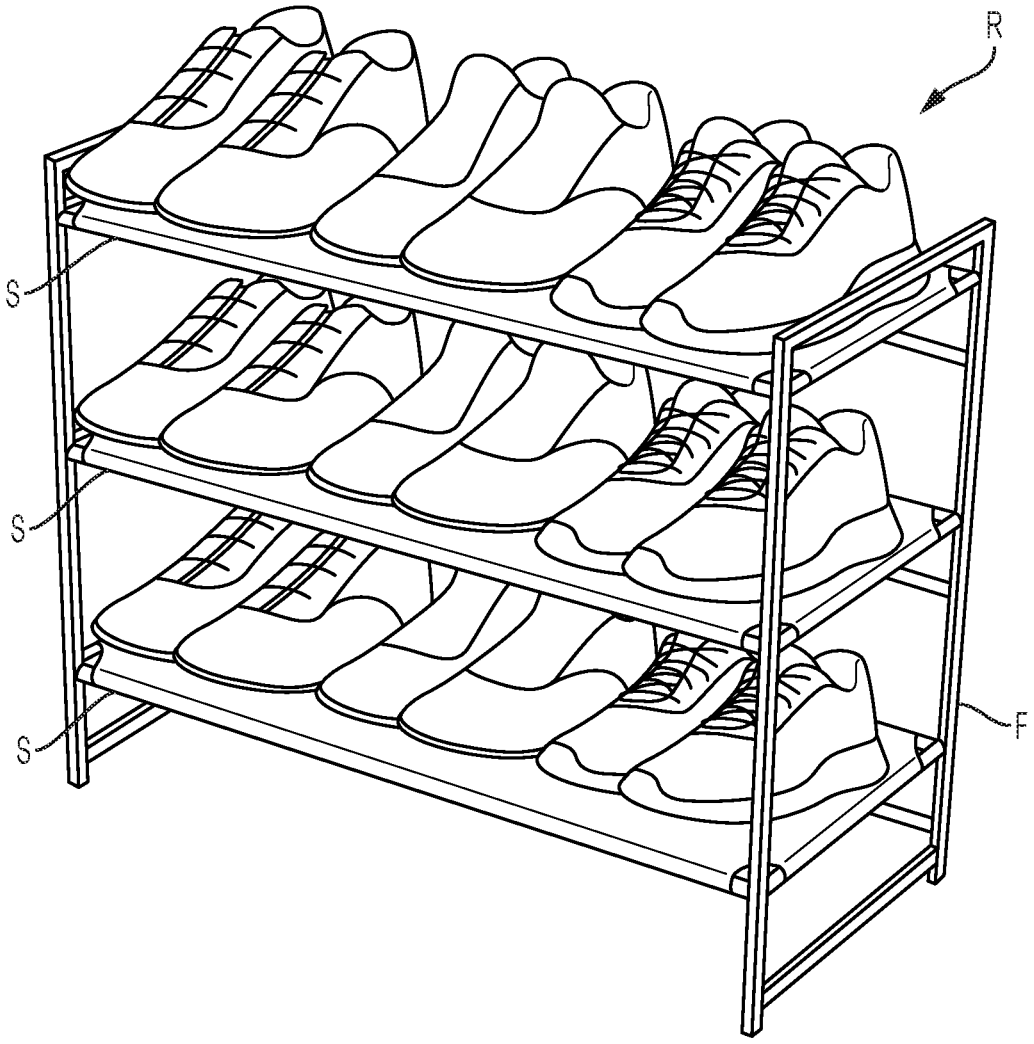
FIG. 1 PRIOR ART
FIG. 1 is perspective view of a typical shoe rack.

A typical shoe rack R, an example of which is shown in FIG. 1, includes a frame F and a plurality of shelves S. Shoes are generally organized on shoe rack R such that a left shoe and a right shoe, of a particular pair of shoes, are stored directly adjacent to one another on a predetermined one of the shelves S. While rack R is sufficient for displaying shoes in a neat and orderly manner, the shoe rack has limited storage, and in situations where space is at a premium, for example, urban apartments, more efficient shoe racks are needed.

The device described herein is configured to optimize storage while maintaining shoe visibility, thus allowing a user to observe a larger collection of shoes before selecting a particular pair of shoes to wear. While the device herein is described in connection with the storage of shoes, it will be appreciated that these concepts may be equally applicable to the storage of any item that comes in pairs.

Figure 2:
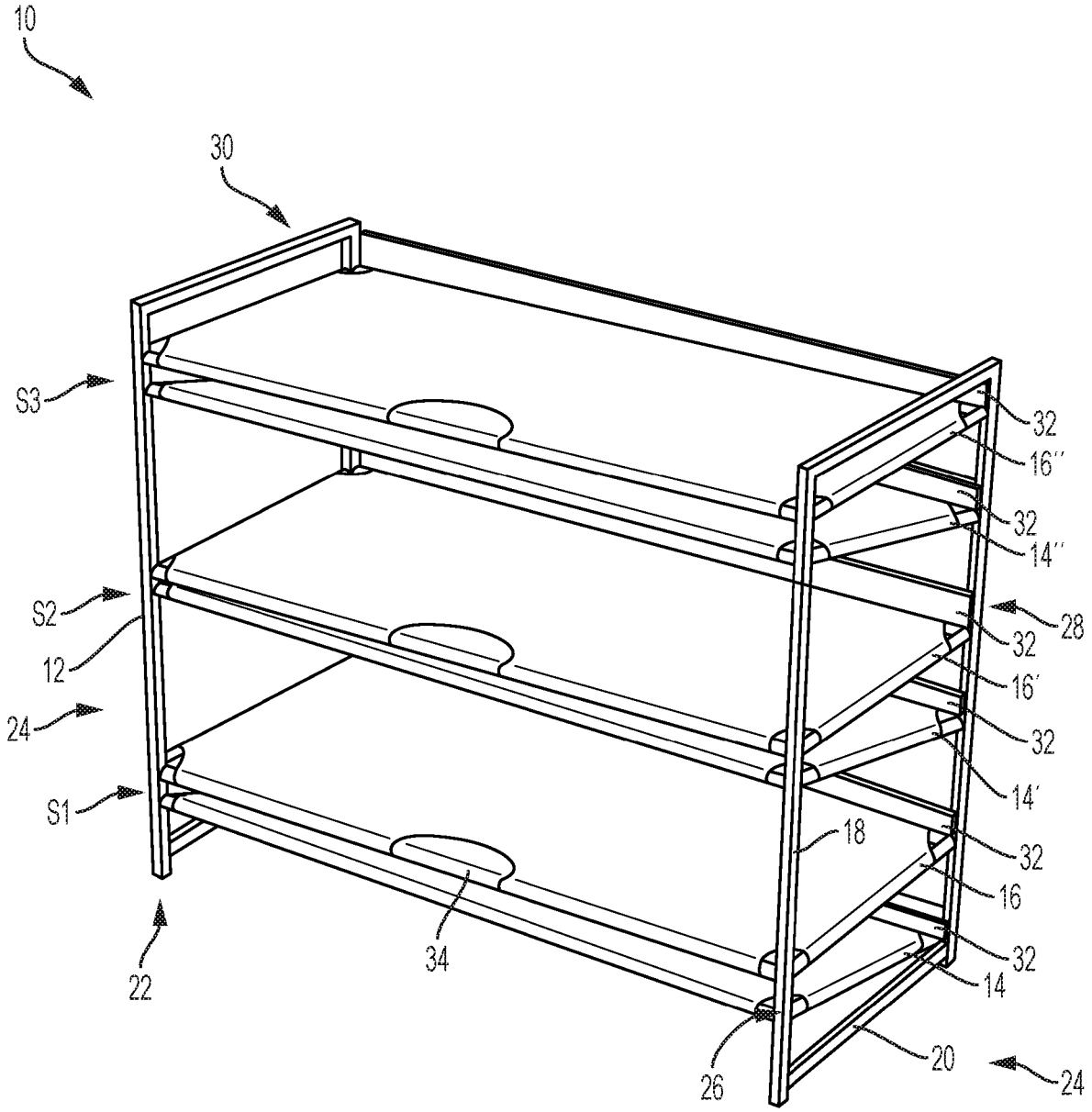
FIG. 2 is a perspective view of a shoe rack in accordance with an embodiment of the invention.

FIG. 2 illustrates an exemplary embodiment of shoe rack 10. The shoe rack includes a frame 12 and a plurality of shelves S1, S2, S3 for storing shoes. Each one of shelves S1, S2, S3 includes a static shelf 14, 14', 14" and a corresponding dynamic shelf 16, 16', 16". Although shoe rack 10, as illustrated, includes three shelves, it will be appreciated that the shoe rack may include as few as one shelf (e.g., a single static shelf and a single dynamic shelf) or as many shelves as is desired. Shoe rack 10 may be formed of metal, plastic, wood, a combination thereof, or any other suitable material known in the art. Furthermore, shoe rack 10 may be configured to be stackable such that a plurality of shoe racks may be stacked on top of one another.

Frame 12 may include vertical support members 18 and horizontal support members 20 that, when assembled, form a base 22, lateral ends 24, a front side 26, a back side 28, and a top 30. Base 22 may be configured to be rested upon a ground surface, and therefore, may optionally include a padded or rubber bottom, preventing damage to shoe rack 10 or the ground upon which it rests, for example, a closet floor. While shoe rack 10 is described hereinafter as being a standing rack, such that base 12 rests on a ground surface, it is also contemplated that frame 12 may include hooks, or a similar device, allowing a user to hang the shoe rack above the ground. Thus, base 22 merely refers to a portion of frame 12 oriented toward the ground surface.

Each one of static shelves 14, 14', 14" is connected to frame 12 at a declined angle such that the static shelf is angled toward base 20 from a front side of the static shelf (i.e., the side of the static shelf nearest the front of the frame) to a backside of the static shelf (i.e., the side of the static shelf nearest the backside of the frame). Static shelves 14, 14', 14" may extend between the lateral ends 24 of frame 12 and be spaced apart from one another in a vertical direction such that static shelf 14 is elevated a distance above base 12, static shelf 14' is spaced a distance above static shelf 14, and static shelf 14" is spaced a distance above static shelf 14'. Static shelves 14, 14', 14" may be fixed relative to the frame such that each one of the static shelves are unable to move relative to the frame.

In order to prevent shoes from sliding off of static shelves 14, 14', 14", each of the static shelves may be provided with a stopping member 32 near the back end of the static shelf. Additionally, or alternatively, an upper surface of static shelves 14, 14', 14" may include a padded or gripping surface to prevent the shoes from sliding off of the declined static shelves.

Each one of the dynamic shelves 16, 16', 16" is connected to frame 12 directly above its corresponding static shelf 14, 14', 14". More specifically, dynamic shelf 16 is provided above static shelf 14 and beneath static shelf 14', dynamic shelf 16' is provided above static shelf 14' and beneath static shelf 14", and dynamic shelf 16" is provided above static shelf 14" and beneath the top end 30 of frame 12.

Each one of dynamic shelves 16, 16', 16" is pivotally connected to frame 12 and may be configured to pivot about a corresponding axis P, P', P" extending along the back side 28 of the frame, allowing the dynamic shelves to move from a first position in which the dynamic shelf is horizontally oriented with respect to a ground surface to a second position in which the dynamic shelf is pivoted away from its corresponding static shelf 14, 14', 14" as is further explained below. Dynamic shelves 16, 16', 16" may be provided with a handle 34 near a front side of the shelf (i.e., the side of the dynamic shelf nearest the front of the frame) in order to assist a user in pivoting the dynamic shelf. Like each one of static shelves 14, 14', 14", dynamic shelves 16, 16', 16" may include a stopping member 32 at or near a back end of the dynamic shelf (i.e., the end of the shelf facing the backend of the frame) and/or a padded upper surface.

Figure 3:
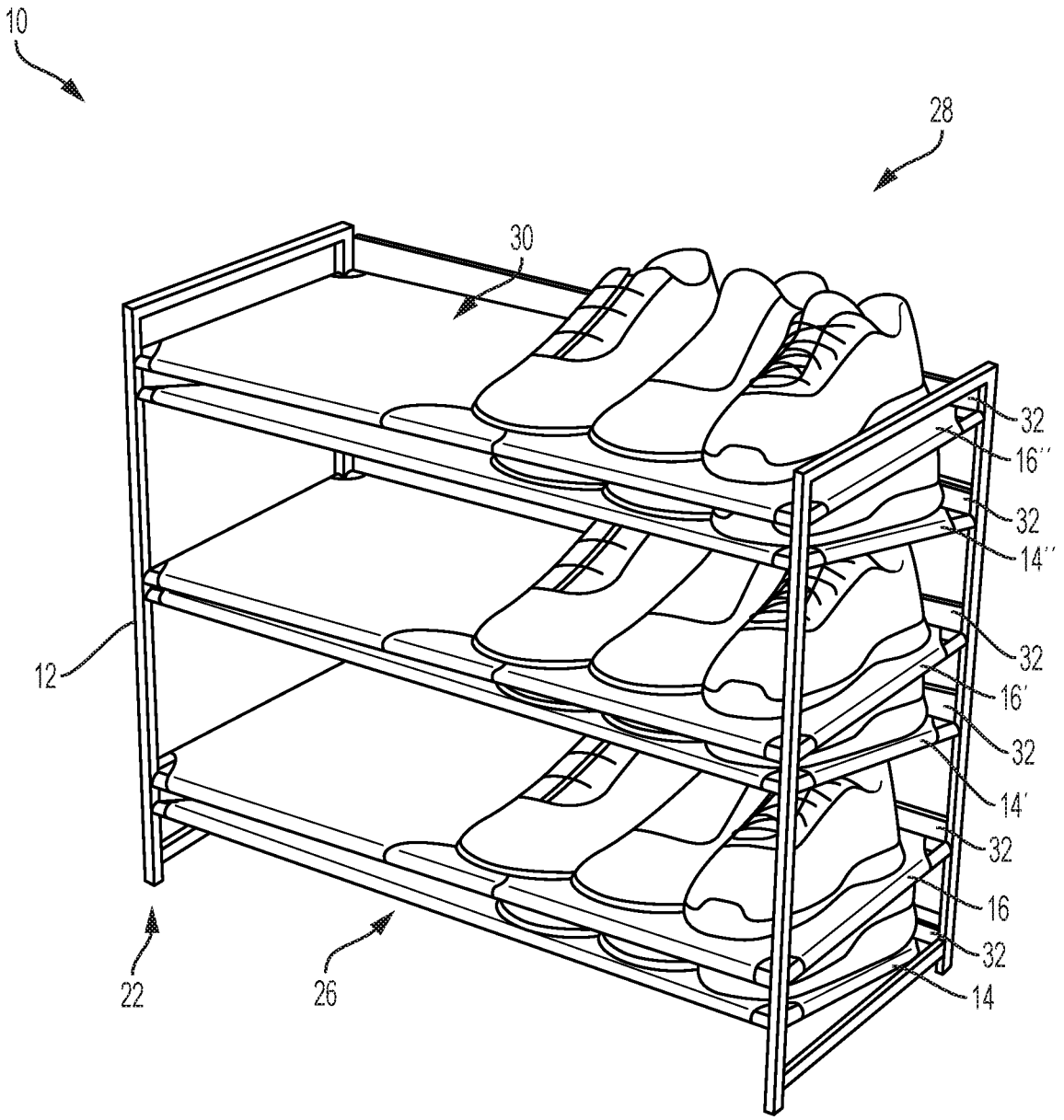
FIG. 3 shows an exemplary manner in which shoes may be stored on the shoe rack of FIG. 2.
Figure 4:
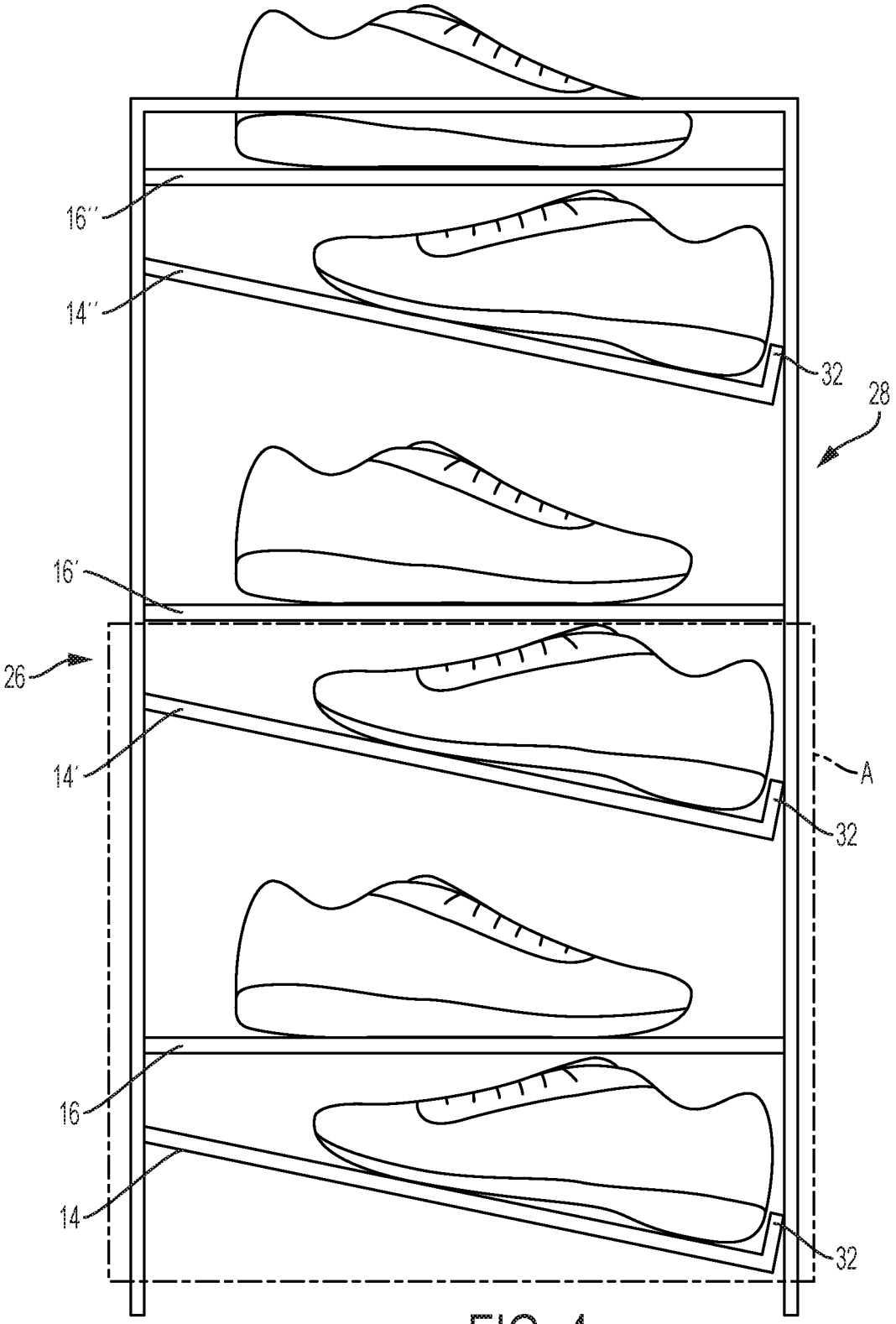
FIG. 4 is a side view of the shoe rack of FIG. 3.

FIGS. 3 and 4 illustrate the storage of shoes on shoe rack 10. Unlike traditional shoe rack R (FIG. 1), shoe rack 10 is designed to store a first shoe (e.g., a left shoe) on one of the static shelves 14, 14', 14" and its matching shoe (e.g., the right shoe) on the respective dynamic shelf.

Each one of dynamic shelves 16, 16', 16" has a respective static shelves 14, 14', 14" provided directly beneath the dynamic shelf. When dynamic shelves 16, 16', 16" are in the first position (i.e., horizontal to a ground surface), each one of the dynamic shelves forms an angle between 10 degrees and 45 degrees with its respective static shelf, thus allowing a pair of shoes to be stored in a stacked configuration (i.e., one shoe on the dynamic shelf and is matching shoe on the static shelf) above one another. As a result, the pair of shoes only occupies a width of the rack that would ordinarily be necessary to store a single shoe.

Dynamic shelves 16, 16', 16" may be spaced apart from one another the same distance as the shelves of traditional rack R. The dynamic shelves, for example, may be spaced apart by a distance of 12 inches or less, for example, 8 inches. Thus, as is shown in FIG. 4, when dynamic shelves 16, 16', 16" are in the first position, static shelves 14, 14', 14" are configured to receive a shoe with minimal clearance between the shoe and the dynamic shelf. As illustrated in FIG. 3, this allows shoe rack 10 to store twice as many pairs of shoes as traditional rack R.

When dynamic shelves 16, 16', 16" are in the first position, horizontal with a ground surface, the shoes stored on static shelves 14, 14', 14" are generally hidden from view and inaccessible to the user. The user will nevertheless be able to visualize one shoe from each pair of shoes (i.e., the shoe on the dynamic rack), thereby assisting a user in selecting a pair of shoes to wear.

Figure 5:
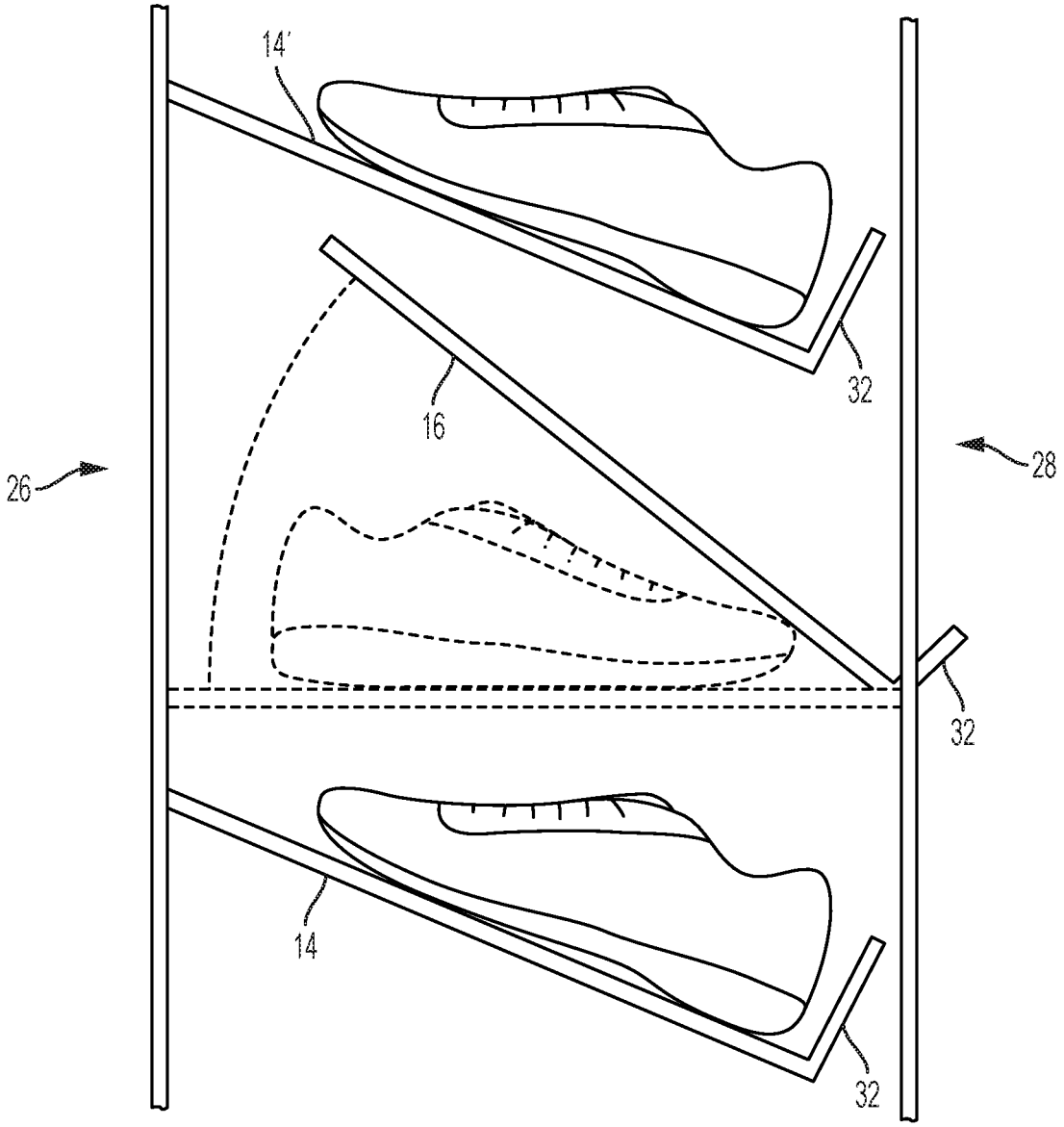
FIG. 5 is a detailed view of section A of FIG. 4, illustrating movement of a dynamic shelf.

FIG. 5 illustrates the pivoting movement of dynamic shelf 16. Since each one of dynamic shelves 16, 16', 16" operates in the same manner, only the operation of dynamic shelf 16 is described herein in detail. The same general principles can be equally applied to dynamic shelves 16', 16".

When dynamic shelf 16 is in the first position (i.e., illustrated in dashed line), the shoe stored on static shelf 14 is inaccessible to the user. In order to access the desired shoe stored on static shelf 14, the user may grip handle 34 and pivot dynamic shelf 16 to its second position (i.e., illustrated in solid line). This causes dynamic shelf 16 to pivot about axis P, moving the dynamic shelf away from its respective static shelf 14 and toward static shelf 14'. When dynamic shelf 16 has moved to its second position, the user will be able to access the shoes on static shelf 14.

When a user wants to retrieve a pair of shoes from shoe rack 10, the user may approach the shoe rack and scan dynamic shelves 16, 16', 16" for the particular shoes he/she wants to wear. After the user has located the desired shoe, the user may grab the selected shoe from dynamic shelf 16, 16', 16". The user may then grip handle 34 of the dynamic shelf upon which the shoe was previously located and pivot the dynamic shelf away from its corresponding static shelf as previously described, providing the user with access to the shoes located on the respective static shelf. Stopping member 32 meanwhile will prevent the remaining shoes from sliding off of the dynamic shelve when it is pivoted. The user may then obtain the matching shoe from the respective static shelf before returning the dynamic shelf to its horizontal position.

The disclosed shoe rack thus advantageously allows a user to store twice as many shoes as a traditional shoe rack, while allowing a user to visualize one shoe, of each stored pair of shoes, before selecting a particular pair to wear.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A storage rack, comprising:

a frame having a base, a front and a back;

a first shelf pivotally connected to the frame; and a second shelf connected to the frame beneath the first shelf, the second shelf being declined toward the base from a side of the second shelf nearest the front of the frame to a side of the second shelf nearest the back of the frame, wherein the first shelf is moveable from a lowest position in which the first shelf is substantially parallel with a ground surface to a declined position in which the first shelf is declined toward the base from a side of the first shelf nearest the front of the frame to a side of the first shelf nearest the back of the frame.

2. The storage rack of claim 1, wherein the second shelf is fixed stationary relative to the frame.

3. The storage rack of claim 1, wherein when the first shelf is in the lowest position, the first shelf and the second shelf form an angle relative to one another between 10 degrees and 45 degrees.

4. The storage rack of claim 1, wherein the first shelf comprises a handle.

5. The storage rack of claim 1, wherein the first shelf includes a stopping member adjacent the side of the first shelf nearest the back of the frame.

6. The storage rack of claim 1, wherein the first shelf pivots about an axis extending along the back of the frame.

7. The storage rack of claim 1, wherein the second shelf includes a gripping surface or a stopping member adjacent the side of the second shelf nearest the back of the frame.

8. The storage rack of claim 1, further comprising:

a third shelf pivotally connected to the frame; and a fourth shelf connected to the frame above the first shelf and beneath the third shelf, the fourth shelf being declined toward the base from a side of the fourth shelf nearest the front of the frame to a side of the fourth shelf nearest the back of the frame, wherein the third shelf is moveable from a first position in which a portion of the third shelf is spaced a distance from the fourth shelf to a second position in which the portion of the third shelf is moved away from the fourth shelf.

9. The storage rack of claim 8, wherein when the third shelf is in the first position, the fourth shelf is configured to receive a shoe with minimal clearance between the shoe and the third shelf.

10. The storage rack of claim 8, wherein when the first shelf is in the lowest position and the third shelf is in the first position, the first shelf and the third shelf are spaced a distance apart of 12 inches or less.

11. A storage rack, comprising:

a frame having a base, a top end, a front and a back;

a plurality of dynamic shelves pivotally connected to the frame and spaced apart from one another; and a plurality of declined shelves connected to the fame, each one of the plurality of declined shelves being angled toward the base of the frame from a front end of the declined shelf to a back end of the declined shelf, the plurality of dynamic shelves and the plurality of the declined shelves being alternatively connected to the frame from the top end of the frame to the base of the frame such that each one of the plurality of dynamic shelves is provided above a respective declined shelf, wherein each one of the plurality of dynamic shelves is moveable relative to the frame from a lowest position in which the dynamic shelf is substantially parallel with a ground surface to a declined position in which the dynamic shelf is declined toward the base from a side of the dynamic shelf nearest the front of the frame to a side of the dynamic shelf nearest the back of the frame.

12. The storage rack of claim 11, wherein the plurality of declined shelves are fixed stationary relative to the frame.

13. The storage rack of claim 11, wherein when one of the plurality of dynamic shelves is in the lowest position, the respective declined shelf is configured to receive a shoe with minimal clearance between the shoe and the one of the plurality of dynamic shelves.

14. The storage rack of claim 13, wherein when the one of the plurality of dynamic shelves is in the lowest position, the one of the plurality of dynamic shelves and the respective declined shelf form an angle relative to one another between 10 degrees and 45 degrees.

15. The storage rack of claim 11, wherein at least one of the plurality of dynamic shelves includes a handle.

16. The storage rack of claim 11, wherein at least one of the plurality of dynamic shelves includes a stopping member.

17. The storage rack of claim 11, wherein at least one of the plurality of dynamic shelves is configured to pivot about an axis extending along a back of the frame.

18. The storage rack of claim 11, wherein at least one of the plurality of declined shelves includes a gripping surface or a stopping member.

19. The storage rack of claim 11, wherein the storage rack comprises three dynamic shelves and three declined shelves.

* * * * *